US005367161A

United States Patent [19]

Outlaw et al.

[11] Patent Number: 5,367,161

[45] Date of Patent: Nov. 22, 1994

[54] SMALL UHV COMPATIBLE HYPERTHERMAL OXYGEN ATOM GENERATOR

[75] Inventors: Ronald A. Outlaw, Newport News, Va.; Mark R. Davison, Florahome, Fla.

[73] Assignee: The United States of America as represented by the Administrator of the National Aeronautics and Space Administration, Washington, D.C.

[21] Appl. No.: 88,963

[22] Filed: Jul. 2, 1993

[51] Int. Cl.[5] ..... H05H 3/00

[52] U.S. Cl. ..... 250/251

[58] Field of Search ..... 250/251, 427

[56] References Cited

U.S. PATENT DOCUMENTS 4,542,010 9/1985 Roman et al. ..... 423/579
4,599,157 7/1986 Suzuki et al. ..... 204/192 SP
4,686,022 8/1987 Rempt ..... 204/157.41
4,828,817 5/1989 Outlaw .

*Primary Examiner*—Bruce C. Anderson
*Attorney, Agent, or Firm*—George F. Helfrich

[57] ABSTRACT

A high purity, hyperthermal, continuous beam atomic oxygen source capable of retrofitting to existing UHV systems has been developed. The instrument complements a general system capability, while its small size and simplicity of design permits tailoring the instrument for most experimental geometries. The flux level presently available is near $1\times10^{14}$ $cm^{-2}s^{-1}$ ($^3P$) but may be extended toward the theoretical limit of $3\times10^{15}$ $cm^{-2}s^{-1}$. The energy distribution of the emitted neutrals shows that the mean kinetic energy is about the same as observed for the ions or about 5 eV. The energy of the oxygen atoms may be substantially reduced for other applications by collision with a temperature controlled, non-reactive surface (with a concomitant spread in the energy distribution).

4 Claims, 10 Drawing Sheets

AP, IE= 0 modes

SMALL UHV COMPATIBLE HYPERTHERMAL OXYGEN ATOM GENERATOR

The invention described herein was made jointly by an employee of the United States Government and a non-government employee and may be used by or for the Government for governmental purposes without the payment of any royalties thereon or therefor.

BACKGROUND OF THE INVENTION

1. Technical Field of the Invention

This invention relates generally to the separation of oxygen molecules into atoms. In particular, it relates to a device for the production of a high purity, neutral hyperthermal atomic oxygen beam, the device being compact and ultrahigh vacuum (UHV) compatible.

2. Description of Related Art

The composition of the atmosphere within the orbital envelope (200–1000 km) combined with the orbital velocity ($\sim 8$ km $s^{-1}$) results in a flux of hyperthermal atomic oxygen ($E \sim 5$ eV, $v \sim 10^{15}$ $cm^{-2}s^{-1}$) impinging on spacecraft surfaces. The extreme reactivity of atomic oxygen leads to numerous chemical unions with other species to form, for example, CO, $CO_2$, $H_2O$, $O_2$, $SO_2$, and $NO_2$. Further, the high chemical reactivity of this O atom flux has caused substantial degradation of organic materials on board the Shuttle and suggests that materials on the proposed Space Station Freedom, the composites used in large space structures, exterior coatings on the optics of the Hubble Space Telescope, the UV telescopes, and future laser communications systems may have substantially reduced lifetimes. It is therefore essential to study the reactivity of these materials to atomic oxygen in ground based laboratories. In order to conduct such laboratory experiments, an atomic oxygen beam generator is required that can accurately simulate the flux and energy (within the appropriate vacuum environment) of the vehicle experience in orbit. In addition to oxygen atom reactions with spacecraft materials, such a beam system would also be of importance in the calibration of mass spectrometers and other detection systems that would be used for mapping the density of gas constituents within the orbital envelope. Such calibration is essential to make accurate measurements of the representative gas environment within the orbital envelope. A pure, well-behaved 0 beam would also be useful for producing an ordered oxide layer for growth of compound semiconductors and superconductors. Methods of thin film growth, such as molecular beam epitaxy (MBE), could fully utilize a directed Q beam to grow desired oxide layers without the residual contaminating effects of backfilled $O_2$ or the limitations of dissociative adsorption. Other areas of interest, such as fundamental surface science and chemical kinetics, are obvious. There are several systems that are presently available for the above applications, but they are, in general, quite large, expensive, not ultrahigh vacuum (UHV) compatible, and require the samples to be brought to their location.

In U.S. Pat. No. 4,828,817 a process for generating a pure atomic oxygen beam was disclosed, which process obviated many of the disadvantages associated with the systems of the prior art. Still lacking, however, was a simple workable, practical device that is small and designed for UHV applications.

SUMMARY OF THE INVENTION

It is accordingly the primary object of the present invention to provide what is not available in the prior art, viz., a small, UHV compatible hyperthermal oxygen atom generator which is simple, yet eminently practical and workable.

This object and its attending benefits were achieved by the provision of an instrument which combines the mechanisms of $O_2$ dissociation and transport of oxygen atoms through a hot Ag membrane to provide a continuous source of Q atoms to a vacuum interface where they are subsequently emitted into the vacuum space by electron stimulated desorption (ESD). A flux of neutral O atoms on the order of $1 \times 10^{+14}$ $cm^{-2}s^{-1}$ ($^3P$) with a kinetic energy of approximately 5 eV and a FWHM of 4 eV generated in UHV is now possible. The geometry of the instrument is such that it is mounted on a 7-cm flange and can be tailored in length and orientation to fit most UHV systems. The data presented here are for ESD-controlled conditions where increases in the flux are strictly linear with electron bombardment current. Transport controlled conditions can be achieved at temperatures as low as 350° C. with membrane thicknesses on the order of 10 $\mu$m.

The instrument of the present invention includes a membrane having two sides, the membrane having the capability of dissociating molecular oxygen into atomic oxygen and dissolving the atomic oxygen into its bulk. A means is provided to expose a first side of the membrane to molecular oxygen, and another means provides an ultra high vacuum environment of a pressure of less than $1 \times 10^{-9}$ Torr on the second side of the membrane. A heating means affords a temperature sufficient to promote dissociation of $O_2$ and the subsequent atomic oxygen permeation to the second side of the membrane, and an exciting means excites atomic oxygen to a non-binding state, resulting in its release from the second side of the membrane as an atomic oxygen beam. The exciting means includes a circular cathode in operative association in a plane above or below the membrane cooperating with a circular electron reflector positioned concentrically outwardly from the circular cathode.

BRIEF DESCRIPTION OF THE DRAWINGS

For a more complete understanding of the present invention, including its primary object and attending benefits, reference should be made to the Description of the Preferred Embodiments, which is set forth below. This description should be read together with the accompanying drawing, wherein.

DESCRIPTION OF THE PREFERRED EMBODIMENTS

Figure 1:
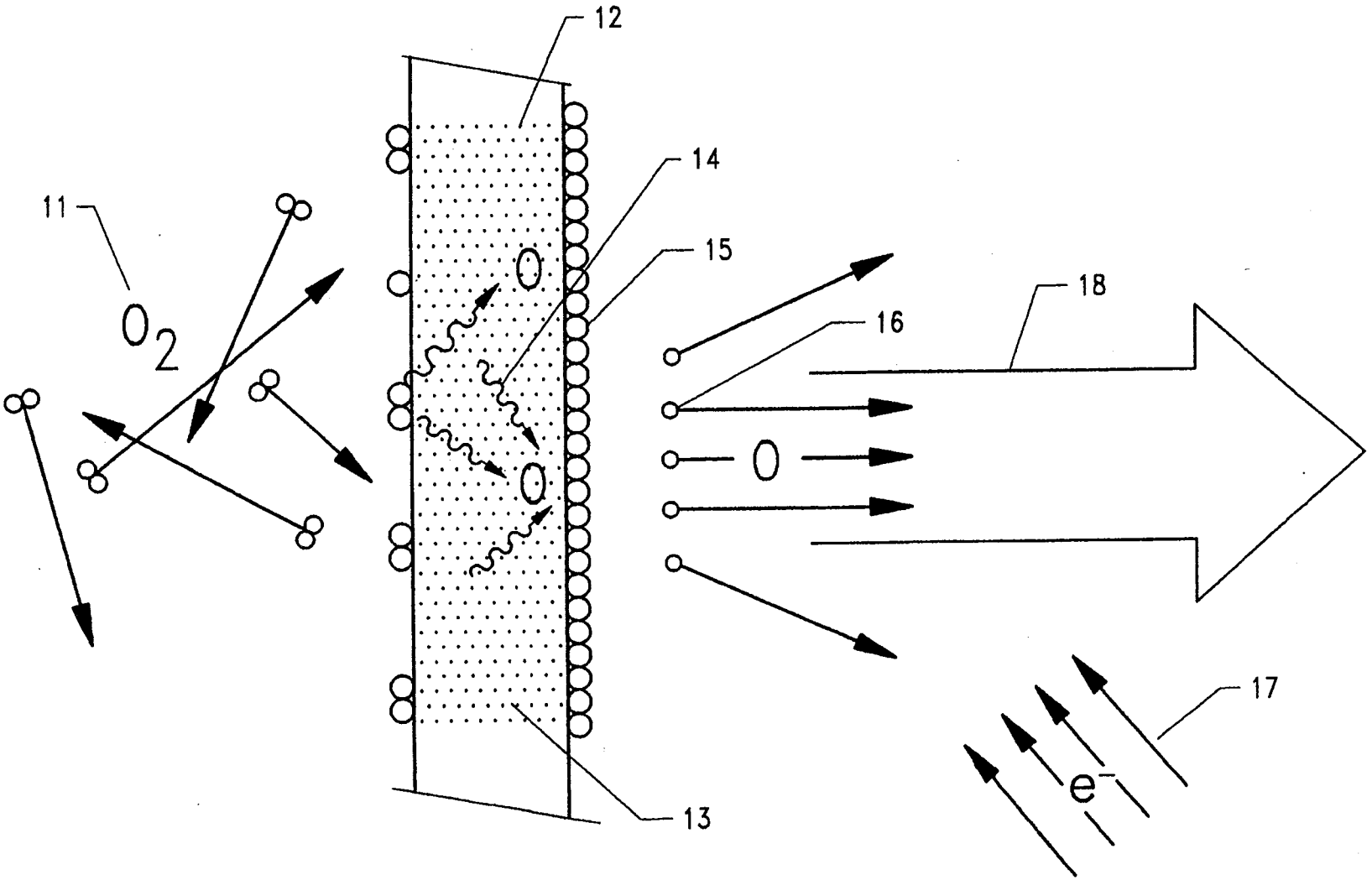
FIG. 1 is a schematic representation of the combined mechanisms of oxygen transport through a membrane followed by emission of hyperthermal O neutrals according to the present invention.

The hyperthermal oxygen atom generator (HOAG) of the present invention employs two different mechanisms. The first is the unusually high permeability of oxygen through Ag and its alloys which occurs by the sequential adsorption of $O_2$, surface dissociation into atoms, dissolution into the bulk, and diffusion of O atoms through a thin membrane where the atoms emerge at the vacuum interface and enter into atomically bound states at the surface ($T<550°$ C). At higher temperatures ($T>550°$ C.), the O atoms which arrive at the vacuum interface have sufficient thermal energy for surface diffusion which ultimately results in recombination and desorption of $O_2$ molecules. The second mechanism is the utilization of electron-stimulated desorption (ESD). By using an incident flux of low energy electrons ($E<2$ kV), the bound atoms are excited to antibonding states and desorb as O neutrals with kinetic energies of about 5 eV. FIG. 1 shows the combination of these two processes schematically. Usually, ESD is conducted on dosed surfaces where the emission is a function of the decay in surface coverage. Eventually, the coverage becomes so low that redosing is required to continue the study. In the case presented here, a continuous source of molecular oxygen 11 is provided (upstream), usually $0.1 \leqq p \leqq 1000$ Torr, to resupply the UHV interface 12 (downstream) by permeation through a membrane 13, e.g., Ag alloy of thickness <0.254 mm. This, of course, means that the Ag membrane 13 must be operated at a temperature high enough to ensure a sufficient oxygen permeability, but yet low enough that the atomic adsorbed state is stable, and molecular oxygen is not formed; i.e., $350° \text{ C.} \leqq T \leqq 450°$ C. The surface coverage of oxygen atoms downstream at the UHV interface 12 is given by $$-\sigma_O \frac{d\theta}{dt} = J_{O/Ag} - J_{O/ESD} \quad (1)$$

where $\theta$ is the surface coverage $J_{O/Ag}$ is the oxygen atom flux through the Ag membrane 13, $J_{O/ESD}$ is the electron stimulated desorption of oxygen, and $\sigma_o$ is the monolayer surface concentration.

The limiting mechanism is determined primarily by membrane temperature, thickness, and upstream pressure for the transport and by electron bombardment flux and energy for ESD.

The original proof of concept of these combined mechanisms was accomplished by charging an Ag wire with 100 Torr of oxygen at 500° C. for one hour to provide a high concentration of oxygen in solid solution. Then, after evacuation to the UHV region, the wire was heated while simultaneously bombarding the surface with 100 eV electrons at a current of 0.5 mA in direct line of sight to the ion source of a quadruple mass spectrometer (QMS). A very clear and unambiguous atomic oxygen peak was observed and found to behave predictably and characteristically on the relevant transport and ESD parameters.

Accordingly, referring again to FIG. 1, $O_2$ dissociates and diffuses 14 through membrane 13. Oxygen atoms emerge 15 and desorb 16 by electron stimulated desorption 17 ($E_p \sim 100$–$2000$ eV, $1_p \sim 0.1$–$10$ mA cm$^{-2}$), resulting in pure oxygen atom beam 18.

Figure 2A:
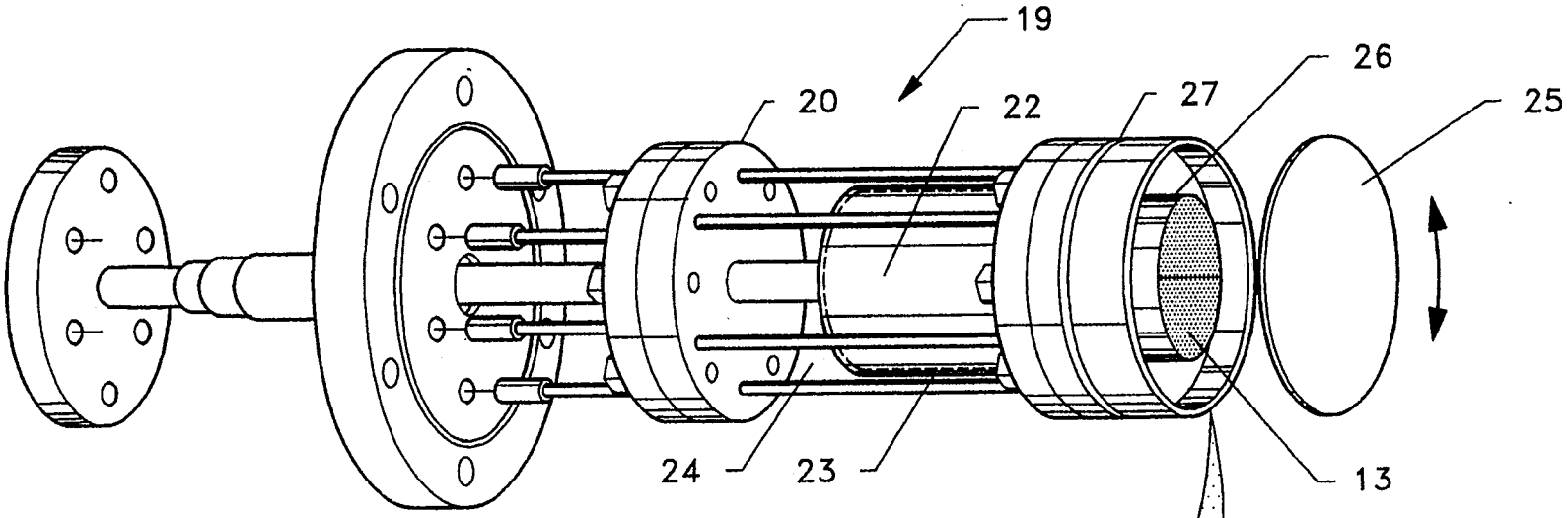
FIG. 2A is a schematic of a device according to the present invention.
Figure 2B:
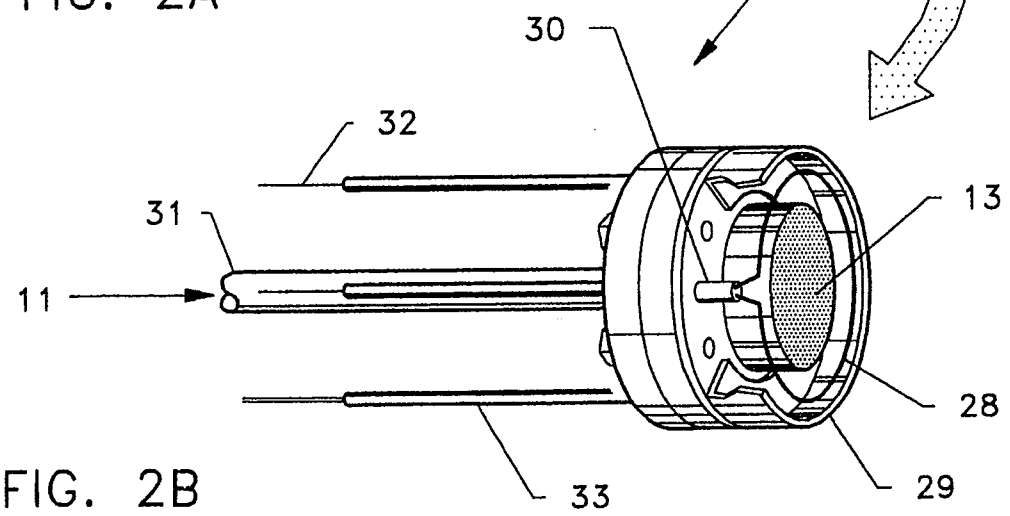
FIG. 2B is a detailed inset showing a top hat membrane, a circular cathode, and a reflector of the device of FIG. 2A.

Referring now to FIG. 2A, a device 19 according to the present invention is shown mounted on an 8-pin, 7-cm diameter conflat flange 20. The overall length of the device can be constructed to fit any size (>10 cm) or desired curvature. The intermediate flange 20 is for simple replacement of the membrane assembly 21, which is shown in detail in FIG. 2B. Heater 22 includes two concentric layers of 0.025 cm NiCr wire coils mounted on a machinable ceramic (e.g., Macor) mandrel, and provides sufficient heat to adjust membrane 13 to temperatures in excess of 800° C., any temperature above 550° C. being employed to clean membrane 13. Tantalum radiation shield 23 prevents heat up of system chamber 24, and shutter plate 25 minimizes membrane or target contamination prior to procedural clean up and provides an instant turn-on and turn-off capability. Membrane 13 is insulated 26 from flange 27 in order to allow a bias voltage for optimum electron and ion optics. Referring now to FIG. 2B wherein heater 22 is not shown, top hat permeation membrane 13, which is advantageously either silver or a silver alloy, is seen in operative association with circular cathode 28, which is any electron source advantageously a thoriated tungsten or iridium filament of 0.025 cm diameter, which filament is located in a plane that is depending on the reflector design, operatively higher (e.g., 0.1 cm) or lower than the surface of top hat membrane 13. Circular cathode 28 is concentric with electron reflector assembly 29, in order to ensure a uniform electron bombardment over membrane 13, which will generate a uniform atomic oxygen flux. Circular cathode 28 is positioned and secured by means of ceramic filament support 30. A continuous source of molecular oxygen (11 in FIG. 1) is supplied through conduit 31. Repeller 32 is a metallic member which repels electron emanating from circular cathode 28 so that a uniform electron bombardment will occur on the surface of top hat membrane 13. A thermocouple assembly is shown at 33.

Figure 3A:
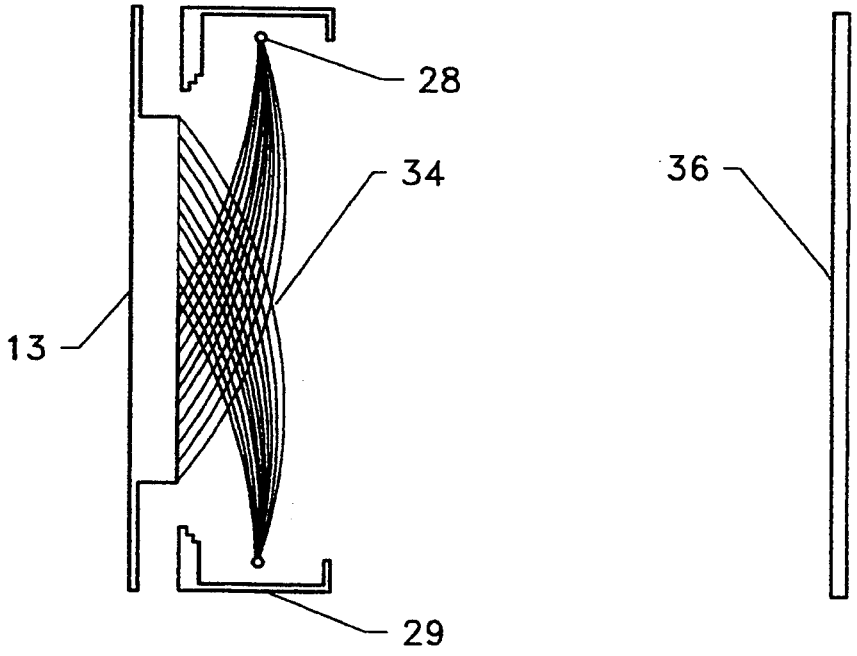
FIG. 3A is a Simion computer simulation of the electron trajectories for the cathode/reflector assembly of FIG. 2B.
Figure 3B:
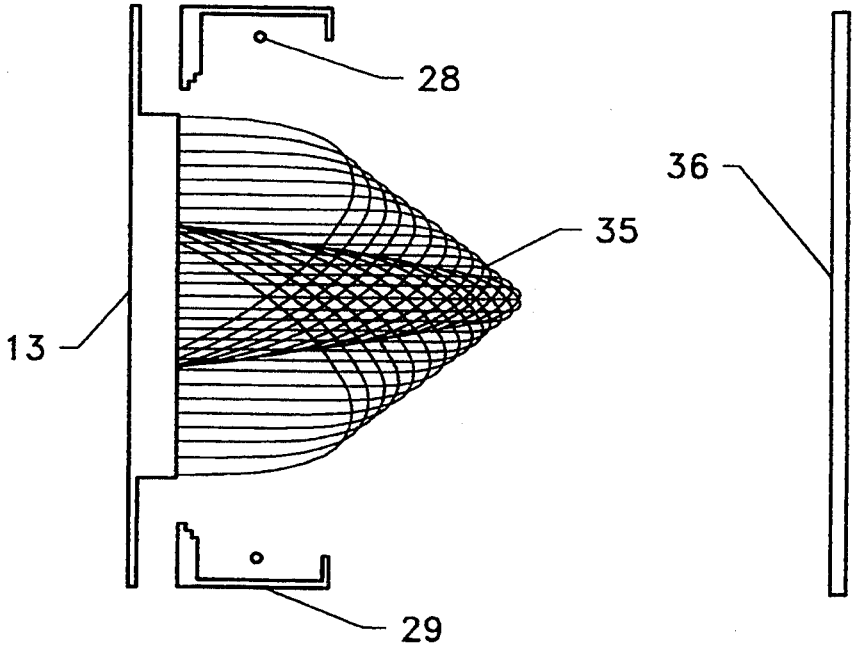
FIG. 3B is a Simion computer simulation showing that highly energetic secondary electrons have trajectories which return to the emission plane.
Figure 4A:
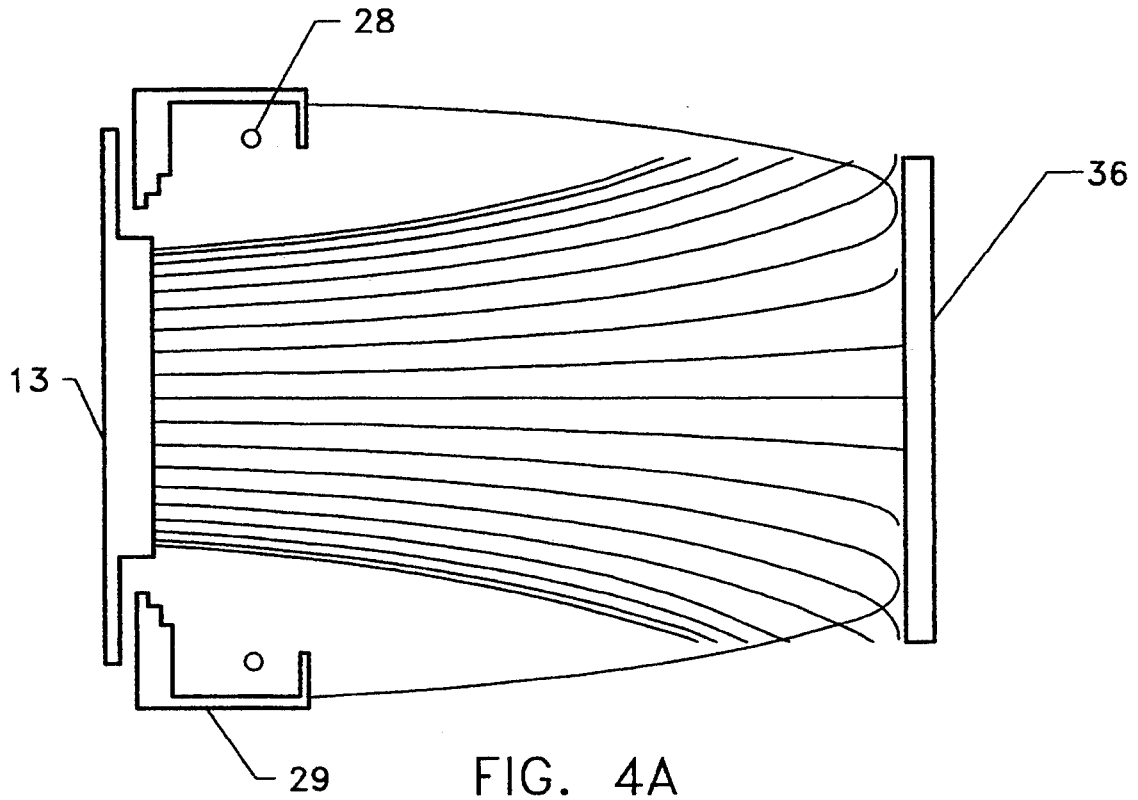
FIG. 4A is a Simion computer simulation of ion trajectories for a sample to target distance of 9 cm.
Figure 4B:
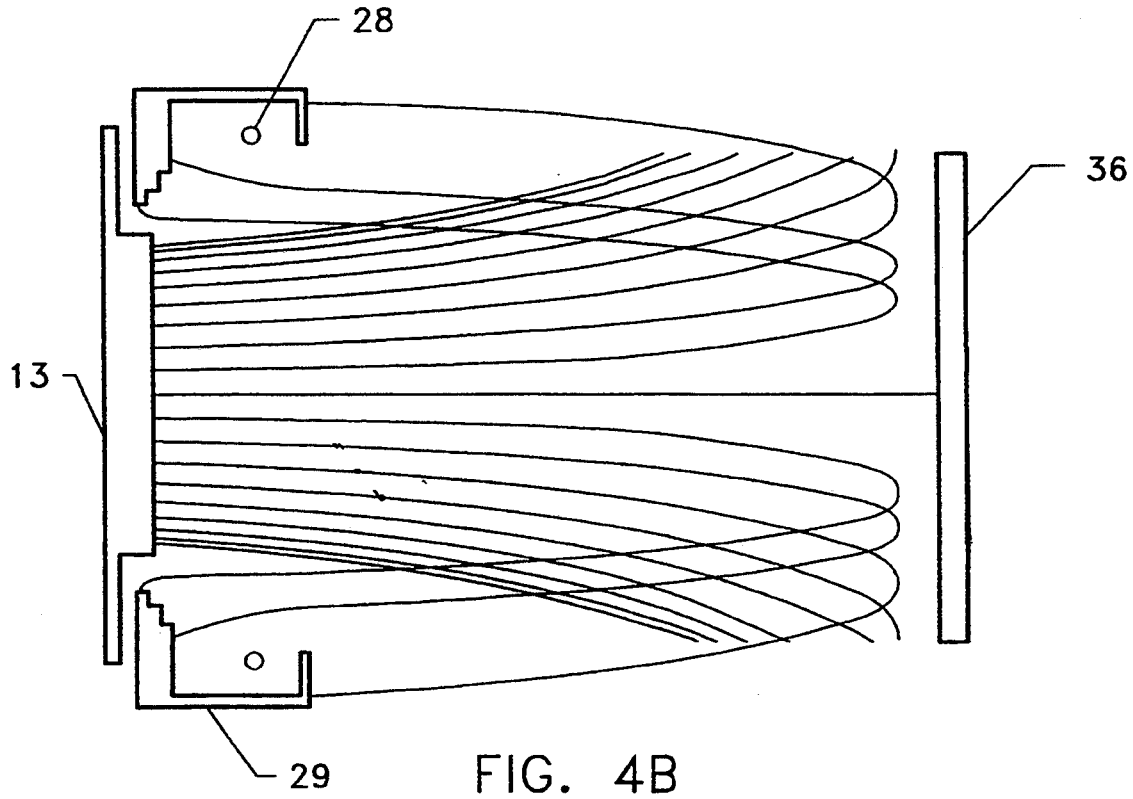
FIG. 4B is a Simion computer simulation showing that when a bias of −80 V is applied, all ions return to the emission plane.

FIG. 3A shows the results of the computer-aided design of electron trajectories 34 using the particular reflector 29/cathode 28 arrangement shown in FIG. 2B. When membrane 13 is operated at ground and cathode 28 is operated at −1700 V, the reflector 29 is operated at +50 V with respect the cathode, which gives the uniform bombardment flux as shown. FIG. 3B shows that even highly energetic secondary electrons (1000 eV) have trajectories 35 which return to the surface of membrane 13 in the potential field shown. The most energetic positive ions (10 eV $O^+$) which are emitted by ESD in this potential field are, in part, going to reach target 36 located 10 cm away. As is shown in FIG. 4A, the ions emitted in parallel paths near the centerline of membrane 13 (normal to the surface of membrane 13) have sufficient energy to escape the potential field of reflector 29. However, if a bias voltage of −80 V is applied to membrane 13, the maximum excursion away from the membrane is 9 cm, so the ions would not arrive at a target 36 or a sample 10 cm away, thus effectively trapping all ion emission within that distance (see FIG. 4B). A separate electrode in front of the emission plane to capture all the ions is also an option, but it is desirable to minimize any scattering or recombination surfaces which may alter the emission flux or purity. Further, this bias does not affect the ESD of O neutrals in any significant way.

Figure 5:
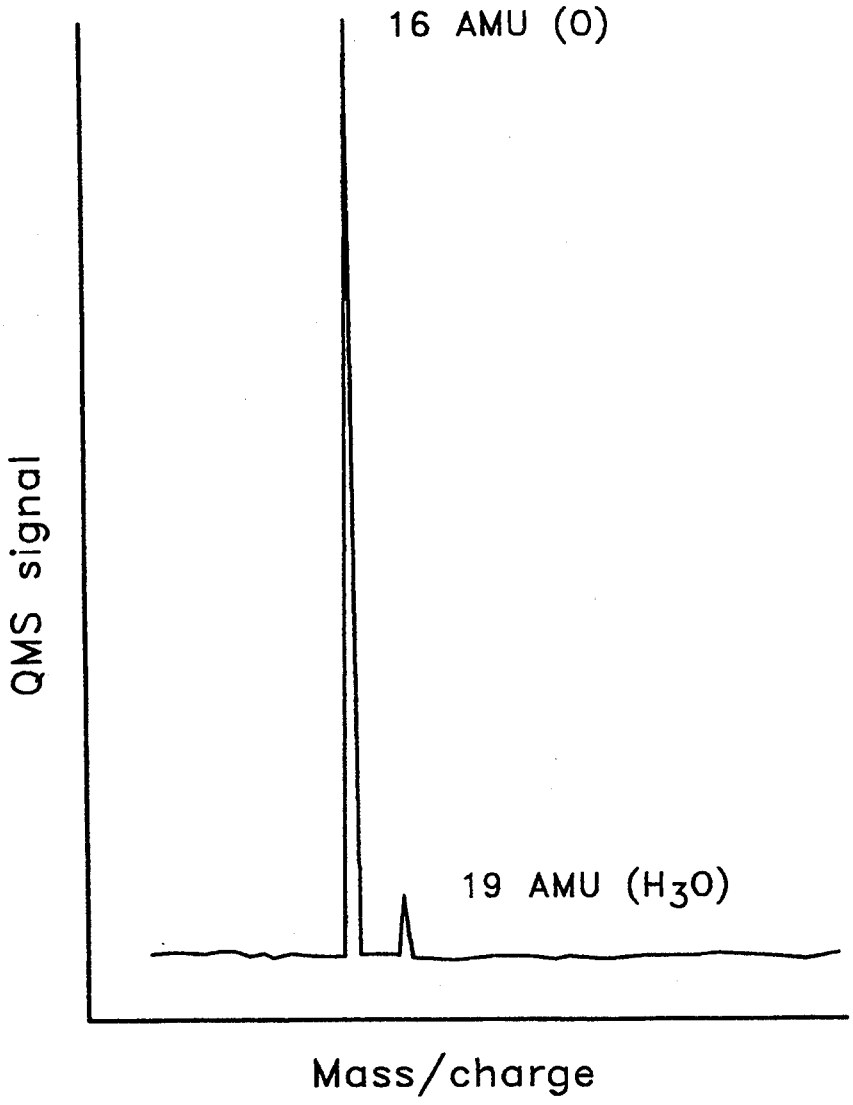
FIG. 5 shows the atomic oxygen signal for a device according to the present invention as detected by a quadruple mass spectrometer (QMS)

The spectra of the hyperthermal oxygen atom generator according to the present invention, as detected by a quadruple mass spectrometer (QMS) with the ionizer in the appearance potential mode and the extractor voltage at 0 V, is shown in FIG. 5. The QMS signal, due to background gases, cuts off at extractor potentials less than 2 V, which indicates that ions with energies less than 2 eV have a negligible probability for transmission through the quadrupole mass filter. At an extractor potential of 0 V the ESD neutrals are detected, but background signals are not. This indicates that ESD neutrals of 2 eV or greater are detected. Clearly, the predominant peak is atomic oxygen. The continuously diminishing peak at m/e=19, which is most likely $H_3O$ from the residual adsorbed $H_2O$, will ultimately disappear after sufficient cleanup. The ionized efficiency for this QMS was determined from $$\frac{J_{out}}{J_{in}} = \frac{Sk_BT}{Aev_{in}} \quad (2)$$

where S is the QMS sensitivity
$k_B$ is Boltzmann's constant,
T is the gas temperature,
A is the area of the aperture,
e is the electronic charge, and
$v_{in}$ is the velocity of the entering particles.

Figure 6:
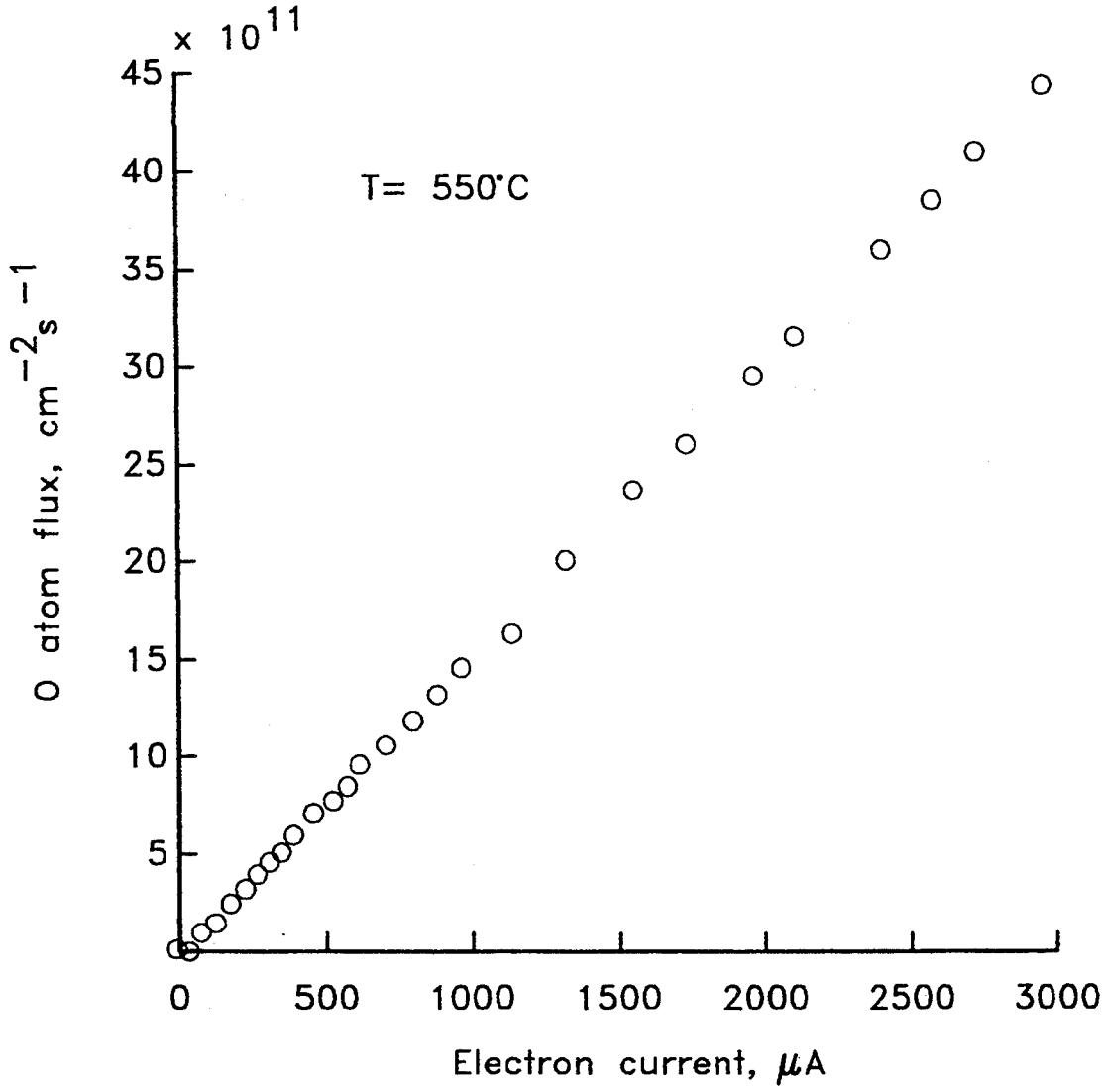
FIG. 6 is a plot of O atom flux as a function of electron bombardment current for a device according to the present invention.

Equation (2) yields an efficiency of $6.4\times10^{-8}$ ions/atom for an emission current of 0.2 mA. This ionizer sensitivity was used to calculate an O neutral/O ion ratio of $1.6\times10^7$. This very high O neutral/O ion ratio may be a result of a dense secondary electron cloud due to the impact of the primaries ($E_e\sim1700$ eV). The emitted ESD ions then experience a high probability of neutralization. The variation in atomic oxygen flux as a function of incident electron flux is shown in FIG. 6. The linearity seen is consistent with normal ESD behavior and indicates that the hyperthermal oxygen atom generator of this invention is ESD limited in this case. The highest flux achieved so far is approximately $5\times10^{13}$ $cm^{-2}s^{-1}$ ($I_c$=20 mA) at a distance of 10 cm from the emission plane. Reflector designs that superimposed the electron flux should double the flux to $\sim1\times10^{-14}$ $cm^{-2}s^{-1}$.

Figure 7:
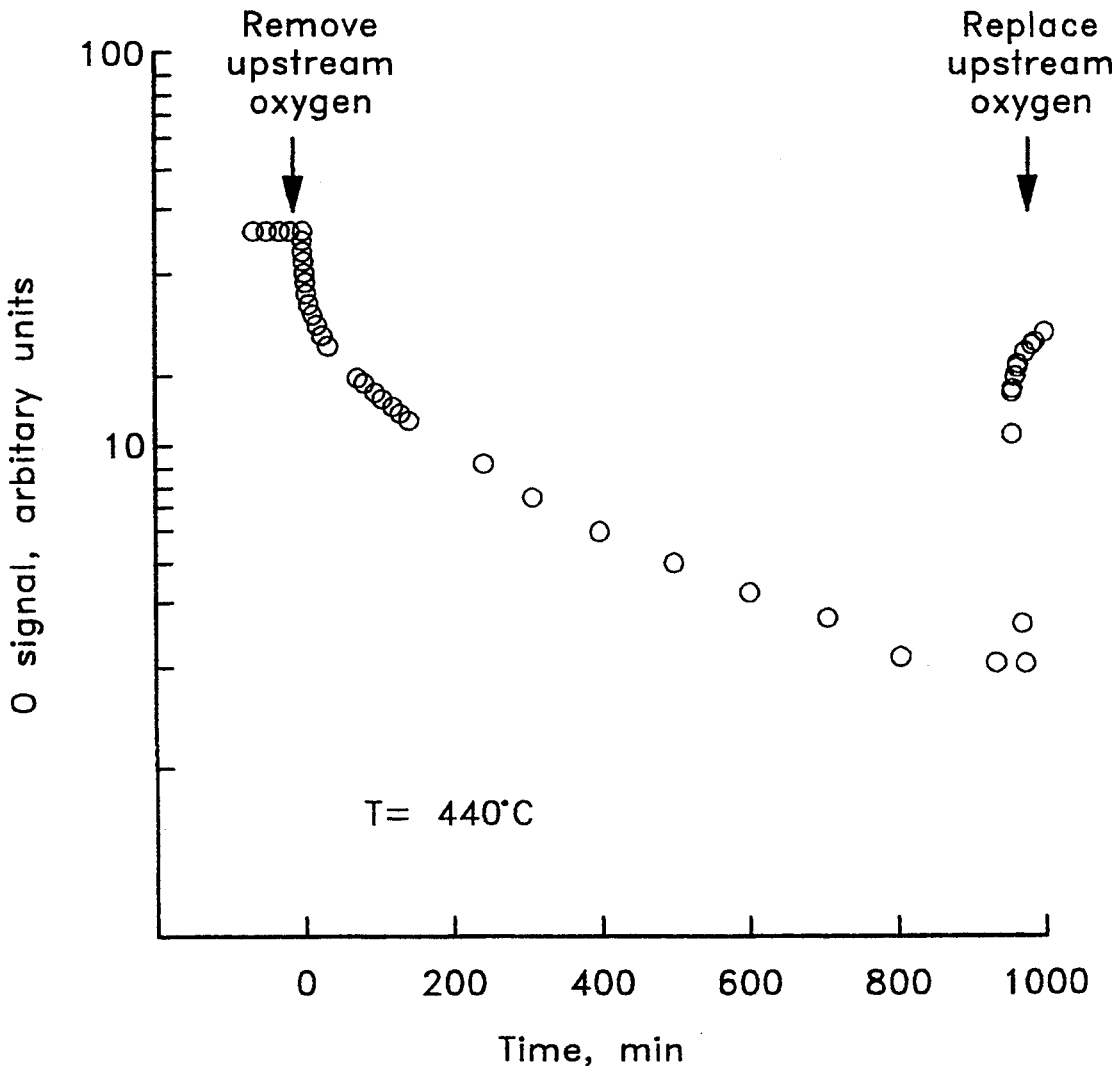
FIG. 7 is a plot of O signal vs. time showing that upstream removal of $O_2$ has an ultimate effect on atomic oxygen flux for a device according to the present invention.

The dependence on the source of molecular oxygen upstream is shown in FIG. 7. A steady-state level atomic oxygen flux was first established at an upstream $O_2$ pressure of 100 Torr. The $O_2$ was then pumped out, and the atomic oxygen signal began to decay. After an arbitrary overnight interval of about 16 hours, the 100 Torr of $O_2$ was reapplied to the upstream side, and the original level of atomic oxygen flux was recovered. This confirmed the source of the atomic oxygen and demonstrated the tandem behavior of the two basic mechanisms of oxygen transport and ESD emission. Adjustment of the upstream pressure of $O_2$ is an optional method of controlling the atomic flux, but is not nearly as quick or easy as adjusting the incident electron flux. From FIG. 7 it is seen that the removal of $O_2$ upstream has an ultimate effect on atomic oxygen flux, but over 14 hours is required to decay a factor of 10.

Figure 8:
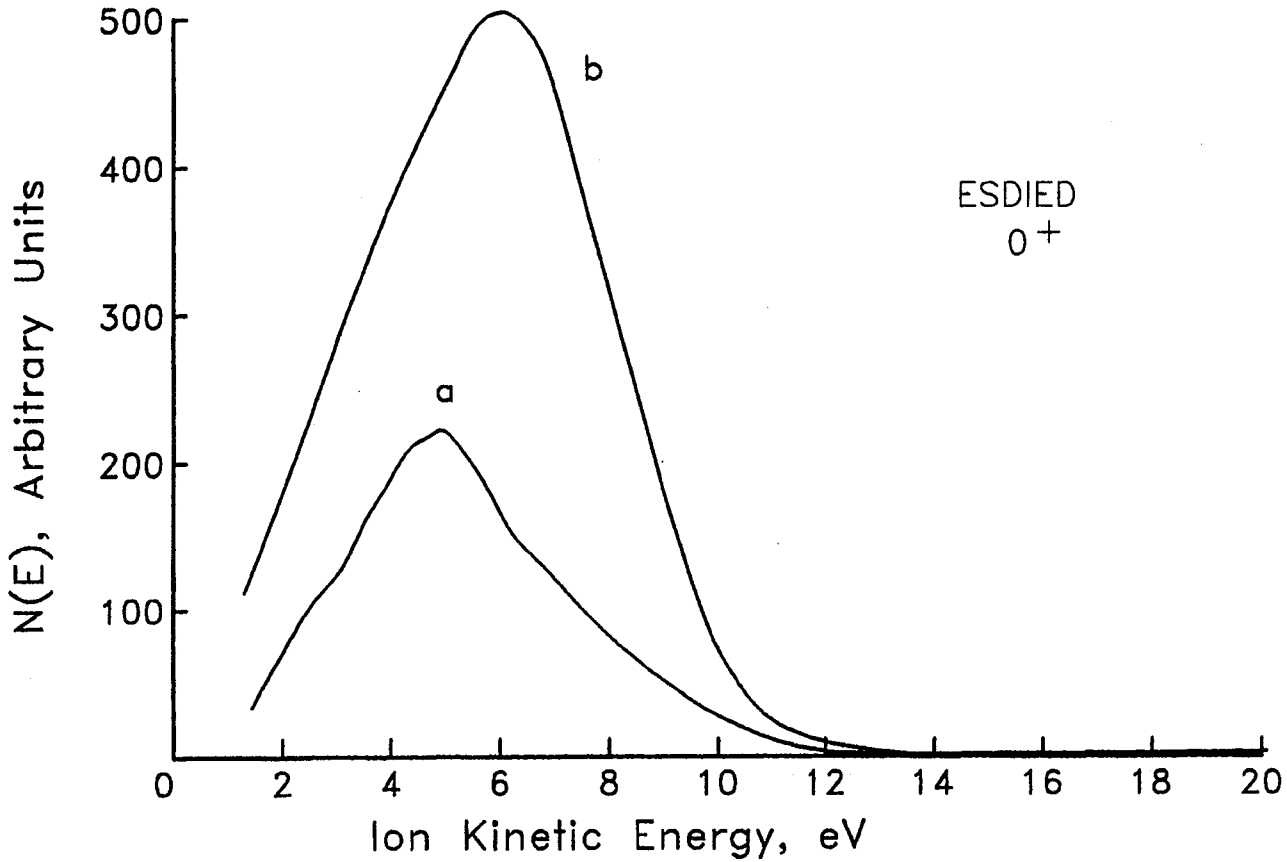
FIG. 8 is a plot showing the ion energy distribution for electron stimulated desorption (ESD) from pure Ag and an Ag 0.5 Zr alloy according to the present invention.

The ion energy distribution for ESD of oxygen from pure Ag (curve "a") and Ag 0.5 Zr alloy (curve "b") is presented in FIG. 8. An estimate of the neutral distribution was accomplished by varying the lens voltage in the QMS from 0 V (where the background gases are repelled) to +10 V where the most energetic oxygen neutrals are repelled. It was found that the mean energy for the neutrals is greater than 2 eV. It is suspected that the distribution is quite similar to the ion distribution which is consistent with the hypothesis that the emitted ions by ESD are neutralized by the secondary electron fog with very little loss of kinetic energy.

Figure 9A:
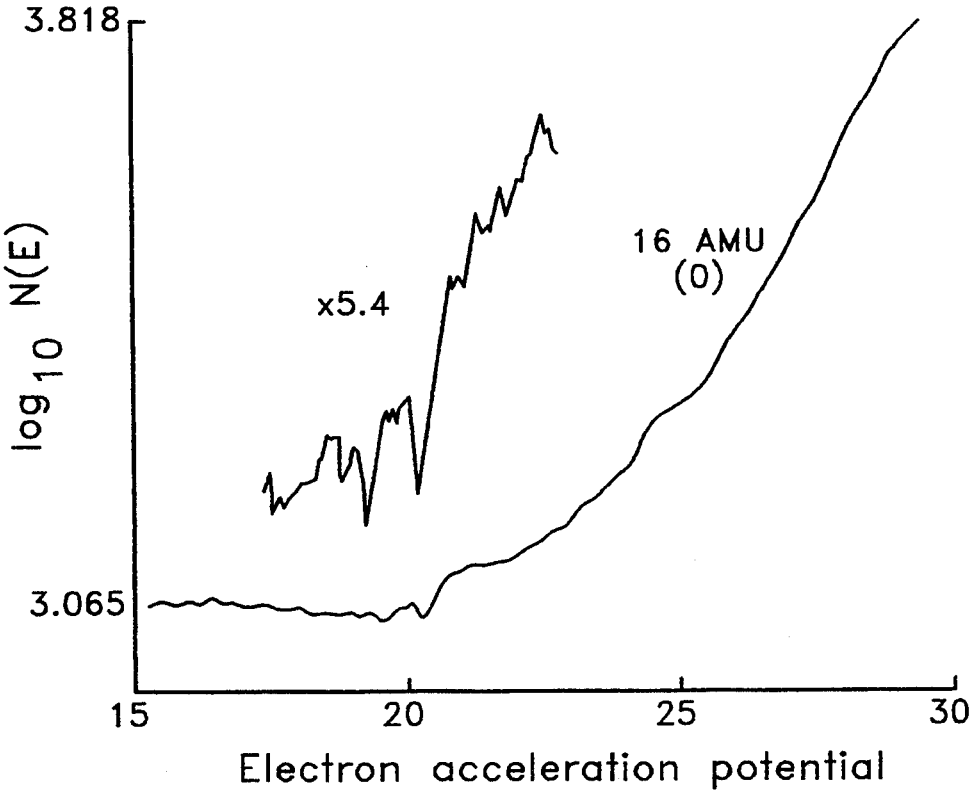
FIG. 9A shows an appearance potential curve for examination of: the internal state of O neutrals from a device according to the present invention.
Figure 9B:
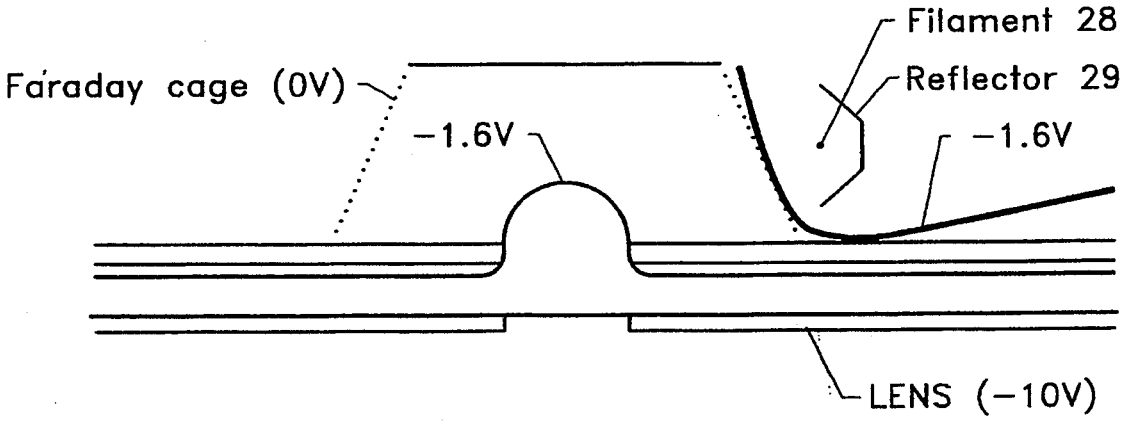
FIG. 9B is a Simion computer simulation for estimation of the field leakage for a device according to the present invention having the specific geometry shown in FIG. 2B.

It is also important to characterize the internal energy of the oxygen atom beam, since it was designed to simulate the ground state flux that exists in low-Earth orbit. FIG. 9A shows an appearance potential curve to examine the internal state of the emitted neutrals by the steps in the appearance potential curves near the ionization energy for atomic oxygen. If these are excited states, e.g., $^1D$, then ionization should occur at a lower energy than the 13.6–13.7 eV necessary for the first ionization potential. This does not appear to be the case since the only step observed is at 19.8 eV. When this measurement is corrected for the W filament work function, which is 4.5 eV, and the effect of field leakage, which was determined to be 1.6 eV, then the predicted value is closely approached. In any case, electron kinetic energy is several eV higher than what would be expected for any excited state population. It is therefore probable that the $^3P$ ground state is the only state. The field leakage for the specific instrument geometry employed was estimated by using the Simion computer simulation, see FIG. 9B, which gives a further correction of 1.6 eV, so that $E_k$=13.7 eV, which is the measured and published first ionization potential for atomic oxygen.

Figure 10:
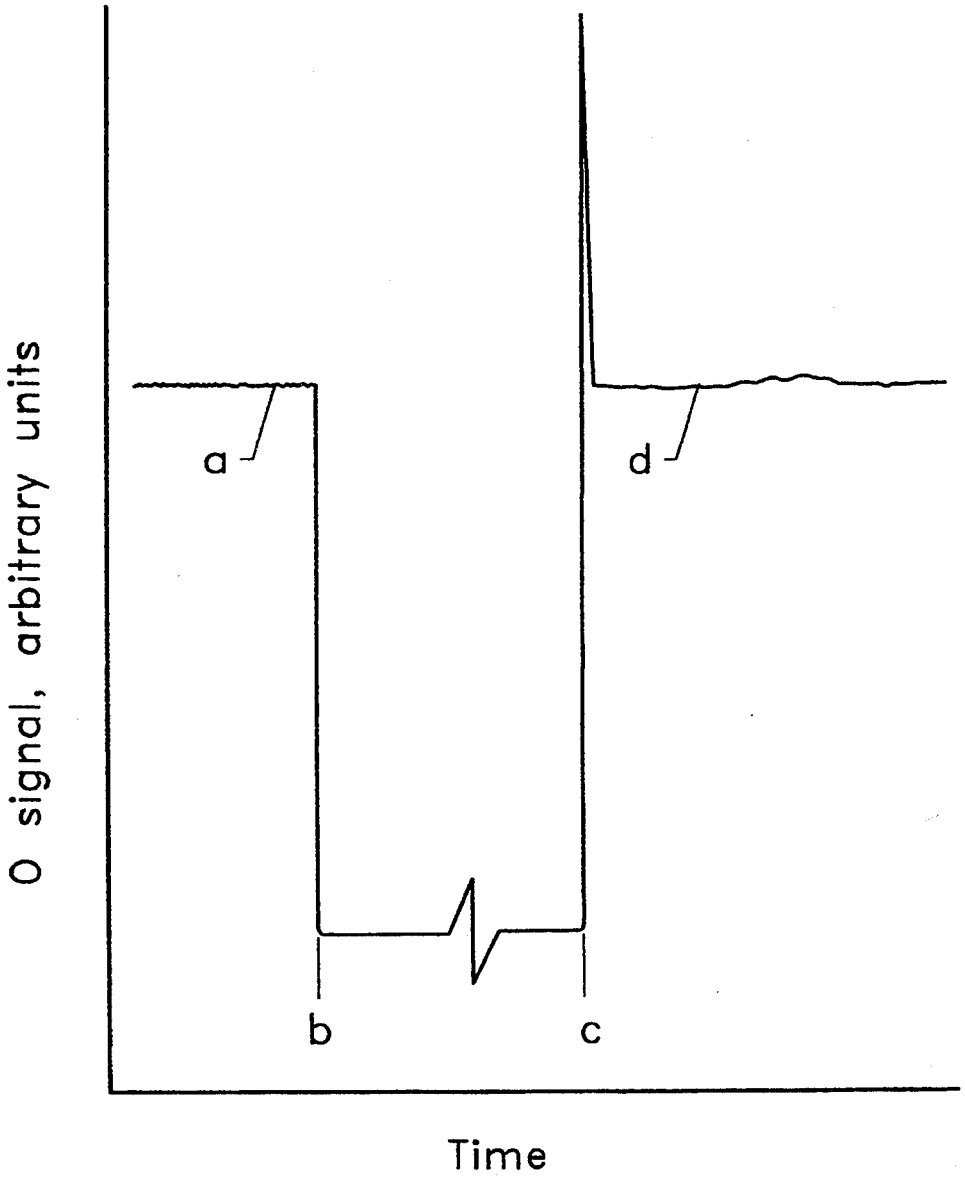
FIG. 10 is a plot showing the initial steady state atomic oxygen flux for a device according to the present invention, followed by removal of the incident electron beam, followed by turning the electron beam on again after five minutes.

It appears quite likely that $1\times10^{14}$ $cm^{-2}s^{-1}$ is achievable before reaching a transport or diffusion limited condition. The cross-over point from ESD control to diffusion control can be easily estimated. FIG. 10 represents the initial steady-state atomic oxygen flux (a), followed by the removal of the incident electron beam (b), and finally the beam being turned back on five minutes later (c). No change in the magnitude of the flux was observed (d), which indicates that the surface coverage was not changed, and therefore, that the hyperthermal oxygen atom generator of the present invention is ESD limited. This is consistent with the data shown in FIG. 6. The transport of oxygen through the membrane ($J_{O/Ag}$)at steady-state is given by $$J_{O/Ag} = \frac{2KP_O^{\frac{1}{2}}}{d} = \frac{2K_OP_O^{\frac{1}{2}}}{d} \exp\left[\frac{-E_K}{RT}\right] \quad (3)$$

where K is the permeability $P_O$ is the normalized upstream pressure (atmospheric fraction), d is the membrane thickness, $E_K$ is the activation energy for oxygen transport (22.7 kcal $mole^{-1}$), T is the membrane temperature, and $K_O$ is the membrane permeability ($5.2\times10^{18}$ $cm^{-1}s^{-1}$).

The flux of ESD ($J_{O/ESD}$) emitted neutrals and ions at steady-state is given by $$J_{O/Ag}=QNJ_{e-} \quad (4)$$

where Q is the ESD cross-section for neutral O/Ag

N is the oxygen concentration, and $J_{e-}$ is the incident electron flux.

At steady-state when $d\theta/dt=0$, then $$J_{O/Ag}=J_{O/ESD} \quad (5)$$

and the temperature where this occurs is given by $$T_c = \frac{E_K}{R}\left[1n\left(\frac{2K_OP_O^{\frac{1}{2}}}{QNJ_{e-}d}\right)\right]^{-1}. \quad (6)$$

At 5 mA incident e− flux, a value of T=406° C. is determined for the cross-over temperature, which for this membrane thickness (0.038 cm) is acceptable. Increasing the incident electron flux to 50 mA to proportionally increase the atomic oxygen flux to $J_o\sim1\times10^{14}$ $cm^{-2}s^{-1}$, gives a cross-over temperature of 513° C., which is too close to the temperature for molecular desorption. It then becomes desirable to reduce the membrane thickness to d=13 μm (this Ag film thickness requires a support structure) where the cross-over temperature becomes a more acceptable $T_c$=365° C.

As is understood by those of skill in this art, the present invention has been described above in detail with respect to certain preferred embodiments. As is also understood by those of skill in this art, variations and modifications in this detail may be effected without any departure from the spirit and scope of the present invention, as defined in the hereto-appended claims.

We claim:

1. An ultrahigh vacuum compatible hyperthermal oxygen atom generator, which comprises:

a membrane having two sides, the membrane having the capability of dissociating molecular oxygen into atomic oxygen and dissolving the atomic oxygen into its bulk;

means for exposing a first side of the membrane to molecular oxygen;

means for providing an ultrahigh vacuum environment having a pressure of less than $1\times10^{-0}$ Torr on the second side of the membrane;

heating means in operative association with the membrane for providing a temperature sufficient for the dissociative adsorption of $O_2$ and promotion of atomic oxygen permeation to the second side of the membrane; and exciting means for exciting the atomic oxygen at the second side of the membrane to a non-binding state so that it is released from the second side of the membrane as an excited atomic oxygen beam, the exciting means comprising the cooperative combination of a circular cathode in operative association with the membrane in a plane above the plane of the second side of the membrane and a circular electron reflector plate positioned concentrically outwardly from the circular cathode so that a uniform electron bombardment over the membrane will be produced.

2. The ultrahigh vacuum compatible hyperthermal oxygen atom generator of claim 1, wherein the membrane is selected from the group consisting of silver and silver alloys.

3. The ultrahigh vacuum compatible hyperthermal oxygen atom generator of claim 2, wherein the circular cathode is a circular filament.

4. The ultrahigh vacuum compatible hyperthermal oxygen atom generator of claim 3, wherein the circular filament is selected from the group consisting of thoriated tungsten and iridium.

* * * * *